US009908346B2

(12) United States Patent
Ishikawa et al.

(10) Patent No.: US 9,908,346 B2
(45) Date of Patent: Mar. 6, 2018

(54) PRINTER APPARATUS

(71) Applicant: FUJITSU COMPONENT LIMITED, Tokyo (JP)

(72) Inventors: Tetsuhiro Ishikawa, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/309,865

(22) PCT Filed: May 26, 2015

(86) PCT No.: PCT/JP2015/065115
§ 371 (c)(1),
(2) Date: Nov. 9, 2016

(87) PCT Pub. No.: WO2015/182613
PCT Pub. Date: Dec. 3, 2015

(65) Prior Publication Data

US 2017/0151813 A1 Jun. 1, 2017

(30) Foreign Application Priority Data

May 30, 2014 (JP) ..... 2014-113250

(51) Int. Cl.
*B41J 11/04* (2006.01)

(52) U.S. Cl.
CPC ..... *B41J 11/04* (2013.01)

(58) Field of Classification Search
CPC . B41J 29/00; B41J 29/02; B41J 29/023; B41J 29/026; B41J 11/04; B41J 25/312;
(Continued)

(56) References Cited

U.S. PATENT DOCUMENTS 6,814,515 B2 11/2004 Tsuchiya et al.
2007/0091162 A1 4/2007 Takabatake
(Continued)

FOREIGN PATENT DOCUMENTS

JP H04-135773 5/1992
JP 2002-019167 1/2002
(Continued)

OTHER PUBLICATIONS

International Search Report dated Aug. 25, 2015.

*Primary Examiner* — Kristal Feggins
(74) *Attorney, Agent, or Firm* — IPUSA, PLLC

(57) ABSTRACT

A printer apparatus includes a print head, a platen roller, and a frame, wherein printing is performed on recording paper situated between the print head and the platen roller, wherein a projection is formed at a side face of the print head, wherein a side face of the frame has a groove formed therein for receiving the projection, wherein the groove includes a first area constituting an entrance to the groove, a second area for positioning the projection and formed such as to extend in a direction intersecting with a direction in which the first area extends, and a slanted part formed between the first area and the second area, and wherein the slanted part is an edge of the groove and extends in a direction different from both a direction in which the projection moves in the first area and a direction in which the projection moves in the second area.

3 Claims, 12 Drawing Sheets

(58) Field of Classification Search
CPC ..... B41J 25/316; B41J 25/304; B41J 25/308; B41J 25/3082; B41J 25/3084; B41J 25/3086; B41J 25/3088
See application file for complete search history.

(56) References Cited

U.S. PATENT DOCUMENTS

| | | | |
|---|---|---|---|
| 2009/0103963 | A1 | 4/2009 | Takabatake et al. |
| 2014/0232806 | A1 | 8/2014 | Tsuchiya et al. |

FOREIGN PATENT DOCUMENTS

| | | |
|---|---|---|
| JP | 2003-019845 | 1/2003 |
| JP | 2004-98699 | 4/2004 |
| JP | 2008-238480 | 10/2008 |
| JP | 2012-171208 | 9/2012 |
| JP | 2013-086282 | 5/2013 |

PRINTER APPARATUS

TECHNICAL FIELD

The disclosures herein relate to a printer apparatus.

BACKGROUND ART

Printers for producing sales receipts or the like are widely used in cash registers used in stores, ATMs (automatic teller machines) or CDs (cash dispensers) installed in banks, etc. In a printer for producing sales receipts or the like, a thermal head or the like prints on thermal paper serving as recording paper while the recording paper is advanced. After the recording paper is advanced a predetermined length, a cutter apparatus cuts a predetermined length of the recording paper from the rest of the paper.

Such a cutter apparatus has a fixed blade and a movable blade. The movable blade is moved toward the fixed blade to cut recording paper that is placed between the fixed blade and the movable blade.

RELATED-ART DOCUMENTS

Patent Document

[Patent Document 1] Japanese Patent Application Publication No. 2003-19845

SUMMARY OF THE INVENTION

Problem to be Solved by the Invention

In the above-noted printer apparatus that uses a thermal head or the like to print on recording paper, the recording paper is placed between the thermal head for printing and a platen roller for advancing the recording paper, and printing is performed while the thermal head is pressed against the platen roller.

Such a printer apparatus typically has a spring for pressing the thermal head toward the platen roller. Removing this spring allows the thermal head to be removed from the printer apparatus. However, the thermal head may easily fall off when the spring is removed or when the printer apparatus is dropped, resulting in the thermal head being damaged.

Accordingly, there is a need for a printer apparatus in which the thermal head does not easily fall off and disengage even when the spring for pressing the thermal head toward the platen roller is removed or when the printer apparatus is dropped.

Means to Solve the Problem

According to an aspect of the embodiments, a printer apparatus includes a print head, a platen roller, and a frame, wherein printing is performed on recording paper situated between the print head and the platen roller, wherein a projection is formed at a side face of the print head, wherein a side face of the frame has a groove formed therein for receiving the projection, wherein the groove includes a first area constituting an entrance to the groove, a second area for positioning the projection and formed such as to extend in a direction intersecting with a direction in which the first area extends, and a slanted part formed between the first area and the second area, and wherein the slanted part is an edge of the groove and extends in a direction different from both a direction in which the projection moves in the first area and a direction in which the projection moves in the second area.

Advantage of the Invention

According to at least one embodiment, a printer apparatus using a thermal head or the like is configured such that the thermal head does not easily fall off and disengage even when the spring for pressing the thermal head toward the platen roller is removed or when the printer apparatus is dropped.

MODE FOR CARRYING OUT THE INVENTION

In the following, embodiments for implementing the invention will be described. The same members or the like are referred to by the same numerals, and a description thereof will be omitted A description will be first given of a typical printer apparatus using a thermal head by referring to FIG. 1 and FIGS. 2A and 2B. The printer apparatus using a thermal head illustrated in FIG. 1 includes a thermal head 910 serving as a print head for printing on recording paper and a platen roller 920 for conveying the recording paper. Recording paper (not shown) for printing, which is placed between the thermal head 910 and the platen roller 920, is advanced by the rotation of the platen roller 920 while the thermal head 910 prints on the recording paper. In such a printer apparatus, a spring 930 presses the thermal head 910 toward the platen roller 920. The spring 930 which is a head pressuring spring has a letter-V shape. The spring 930 in the installed state in the printer apparatus exerts a restoring force such that the letter-V shape widens. The spring 930, which is installed between a frame 940 and the thermal head 910, exerts a restoring force acting in the direction in which the letter-V widens as illustrated by arrows, thereby pressing the thermal head 910 toward the platen roller 920.

In the case of being formed of metal die cast such as aluminum, the frame 940 exhibits high strength, and does not deform even when the spring 930 is placed between the frame 940 and the thermal head 910. Due to requirements for cost reduction, however, the frame 940 may be formed of resin material. In such a case, the resin material is easy to deform, so that installing the spring 930 between the frame 940 and the thermal head 910 to cause the restoring force of the spring 930 to press the frame 940 made of resin material possibly deforms the frame 940. The force exerted by the spring 930 to press the thermal head 910 toward the platen roller 920 may thus diminish. Further, the deformation of the frame 940 may possibly destroy the printer apparatus.

Figure 1:
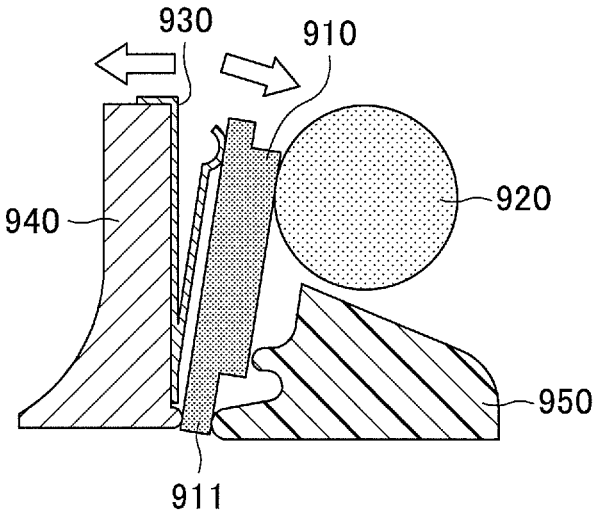
FIG. 1 is a drawing illustrating the structure of a printer apparatus.
Figure 2A:
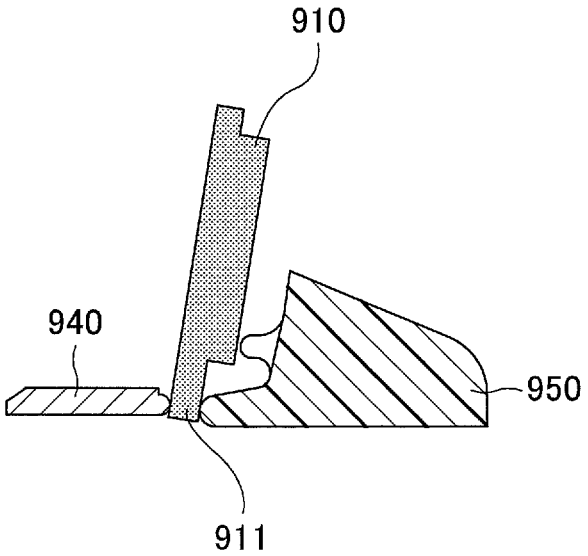
FIG. 2A is a drawing illustrating the printer apparatus.
Figure 2B:
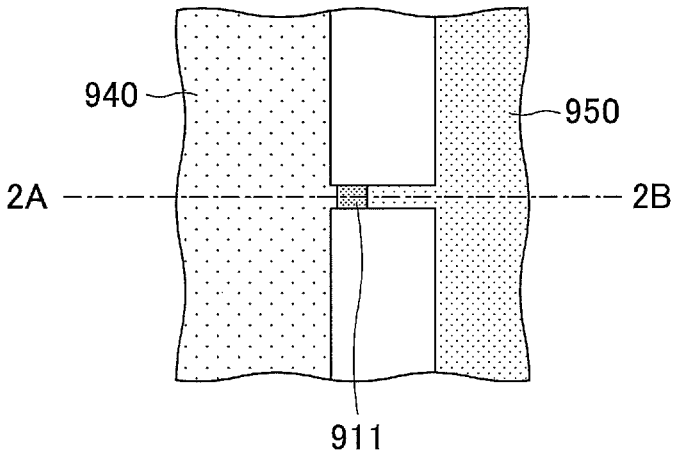
FIG. 2B is a drawing illustrating the printer apparatus.

The printer apparatus illustrated in FIG. 1 has a recording paper guide 950 made of resin material or the like for guiding the recording paper entering the space between the thermal head 910 and the platen roller 920. As illustrated in FIG. 2A, a projection 911 situated at an end of the thermal head 910 opposite from the side of the thermal head 910 for printing on the recording paper (not shown) is placed between the frame 940 and the recording paper guide 950. The projection 911 of the thermal head 910 serves as a rotation axis when the spring 930 presses the thermal head 910 toward the platen roller 920. FIG. 2B is a bottom view of the printer apparatus. FIG. 2A is a cross-sectional view taken along a dot-and-dash line 2A-2B in FIG. 2B.

Figure 3A:
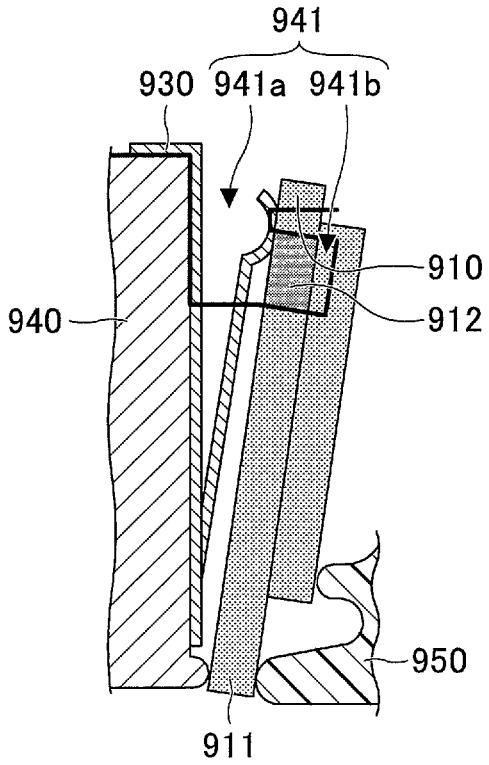
FIG. 3A is a drawing illustrating the printer apparatus.

As illustrated in FIG. 3A, both sides of the thermal head 910 are provided with thermal-head positioning projections 912 that project therefrom, respectively. The side faces of the frame 940 has letter-L grooves 941 formed therein for receiving the thermal-head positioning projections 912, respectively. For the sake of convenience, FIGS. 3A and 3B and FIGS. 4A through 4C show a side face of the frame 940 as being in a transparent state, so that only the outlines of the side face of the frame 940 and the groove 941 are illustrated in solid lines. The letter-L groove 941 includes a straight area 941*a* formed straight near the entrance to the groove and a positioning area 941*b* formed toward a side at the bottom of the straight area 941*a*. The thermal-head positioning projections 912 situated on both sides of the thermal head 910 for being inserted into the letter-L grooves 941 have a rectangular shape. The width of the positioning areas 941*b* is defined such that the thermal-head positioning projections 912 entering the positioning areas 941*b* are settled at a predetermined position. Namely, the thermal-head positioning projections 912 are capable of tightly engaging with the positioning areas 941*b*, which enables the thermal head 910 to be installed at the predetermined position.

In this printer apparatus, the thermal-head positioning projections 912 formed at both sides of the thermal head 910 move into the positioning areas 941*b* from the straight areas 941*a* of the letter-L grooves 941. In the state in which the thermal-head positioning projections 912 are situated in the positioning areas 941*b*, the spring 930 presses the thermal head 910 from the backside thereof toward the platen roller 920, thereby placing the thermal head 910 at the desired position.

Figure 3B:
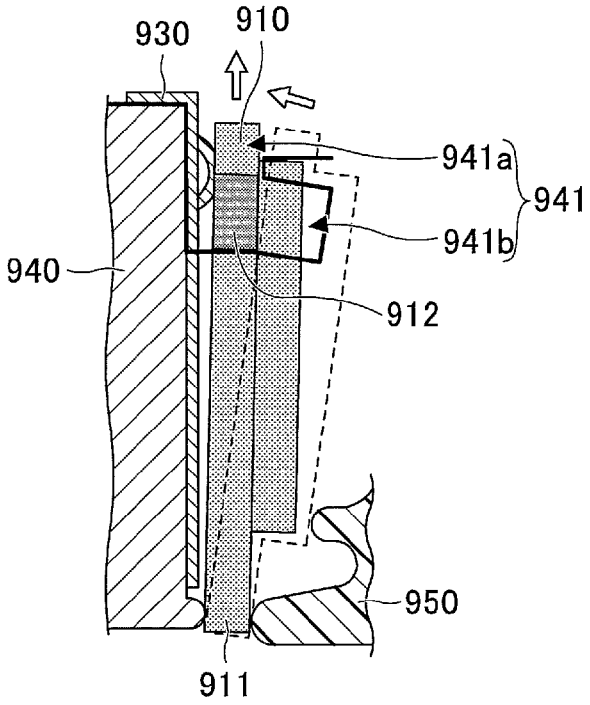
FIG. 3B is a drawing illustrating the printer apparatus.

In order to remove the thermal head 910 from the printer apparatus, the spring 930 is bent against the restoring force of the spring 930, or the spring 930 is removed, followed by moving the thermal-head positioning projections 912 formed at both sides of the thermal head 910 from the positioning areas 941*b* to the straight areas 941*a* of the letter-L grooves 941. In this state, the thermal-head positioning projections 912 formed at both sides of the thermal head 910 are situated in the straight areas 941*a* of the letter-L grooves 941 as illustrated in FIG. 3B. Moving the thermal-head positioning projections 912 along the straight areas 941*a* of the letter-L grooves 941 allows the thermal-head positioning projections 912 formed at both sides of the thermal head 910 to disengage easily.

Figure 4A:
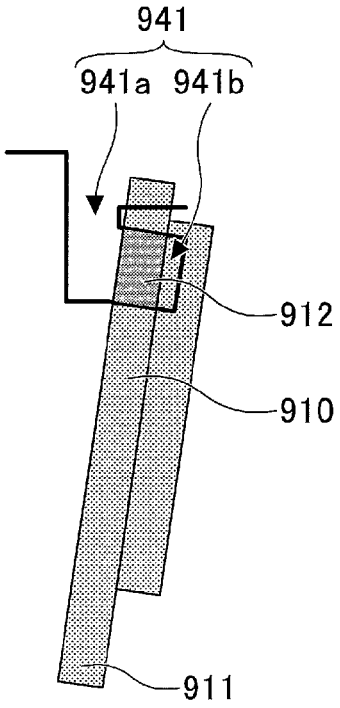
FIG. 4A is a drawing illustrating the printer apparatus.
Figure 4B:
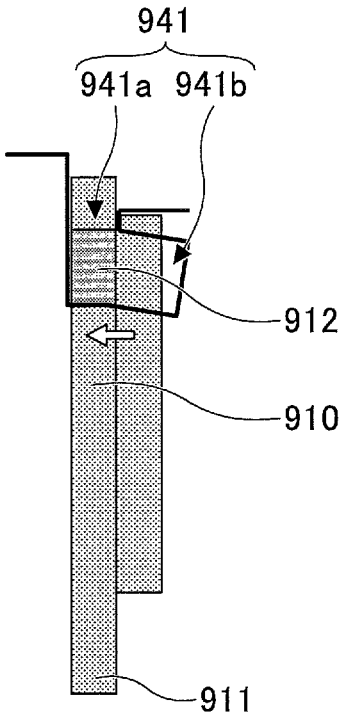
FIG. 4B is a drawing illustrating the printer apparatus.
Figure 4C:
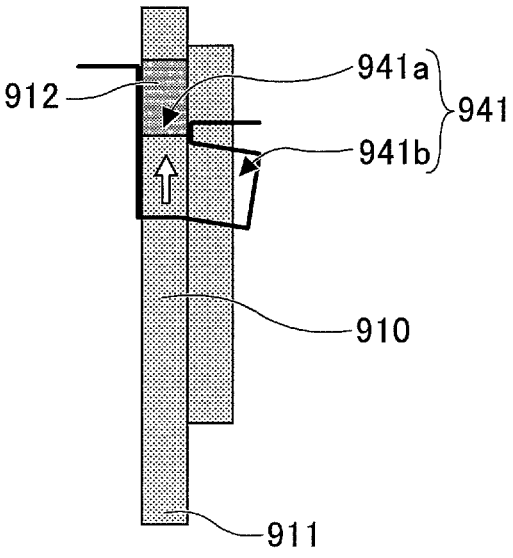
FIG. 4C is a drawing illustrating the printer apparatus.

A more detailed explanation will be given with reference to FIGS. 4A through 4C. In the initial state illustrated in FIG. 4A, the thermal head 910 is pressed toward the platen roller 920 by the spring 930 (see FIG. 3A). In this state, the thermal-head positioning projections 912 formed at both sides of the thermal head 910 are placed in the positioning areas 941*b* of the letter-L grooves 941 formed in the frame 940, so that the thermal head 910 is installed at the predetermined position.

Subsequently, a force is applied to the spring 930 (see FIG. 3B), or the spring 930 is removed, so that the force pressing the thermal head 910 toward the platen roller 920 is removed. As a consequence, the thermal-head positioning projections 912 formed at both ends of the thermal head 910 are moved from the positioning areas 941*b* to the straight areas 941*a* of the letter-L grooves 941 formed in the frame 940 as illustrated in FIG. 4B.

In this state, the thermal-head positioning projections 912 formed at both sides of the thermal head 910 are placed in the straight areas 941*a* of the letter-L grooves 941 formed in the frame 940. As illustrated in FIG. 4C, thus, the thermal-head positioning projections 912 pass through the straight areas 941*a* of the letter-L grooves 941, so that the thermal head 910 falls off.

Figure 5A:
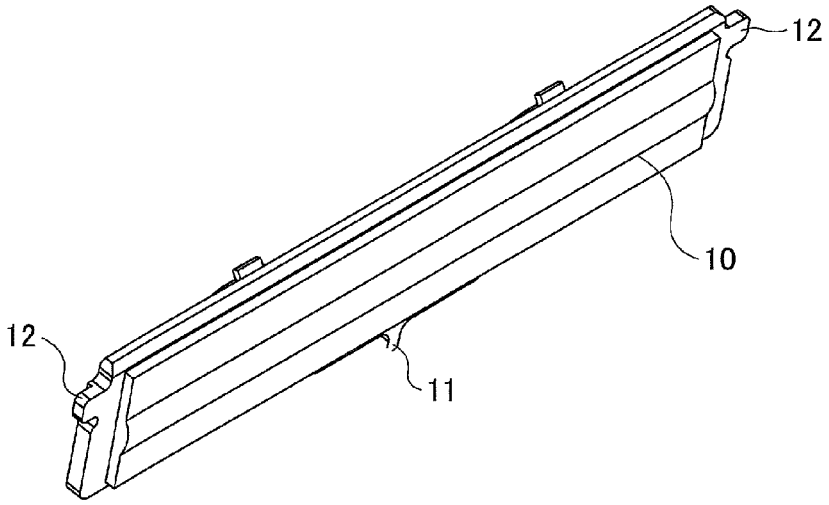
FIG. 5A is an axonometric view of a thermal head of the printer apparatus according to a present embodiment.
Figure 5B:
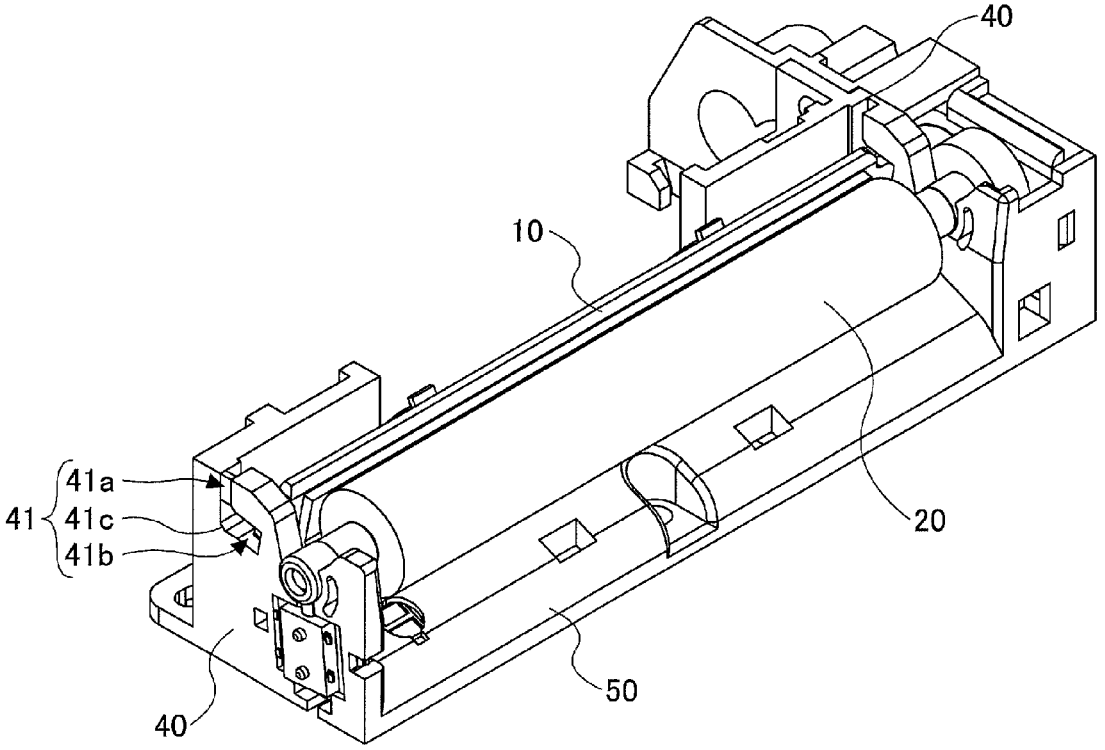
FIG. 5B is an axonometric view of the printer apparatus according to the present embodiment.

In the following, a printer apparatus of the present embodiment will be described with reference to FIGS. 5A and 5B through FIGS. 7A and 7B. FIG. 5A is an axonometric view of the thermal head 10 of the printer apparatus according to the present embodiment. FIG. 5B is an axonometric view of the printer apparatus of the present embodiment. The printer apparatus of the present embodiment includes a thermal head 10 serving as a print head for printing on recording paper and a platen roller 20 for conveying the recording paper. Recording paper (not shown) for printing, which is placed between the thermal head 10 and the platen roller 20, is advanced by the rotation of the platen roller 20 while the thermal head 10 prints on the recording paper. In the present embodiment, the thermal head 10 may have a heatsink plate or the like attached thereto.

Figure 6:
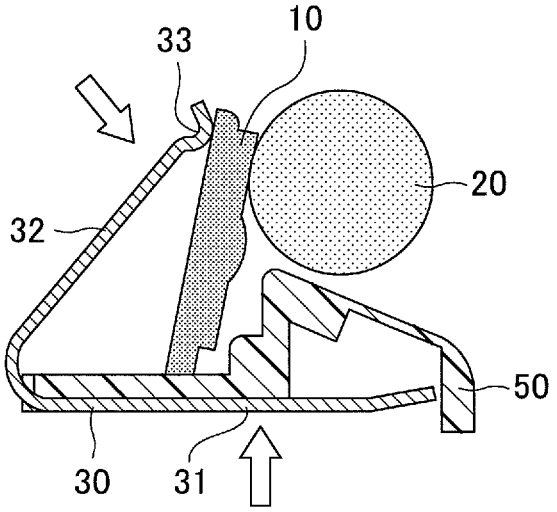
FIG. 6 is a drawing illustrating the structure of the printer apparatus according to the present embodiment.

The printer apparatus of the present embodiment has a letter-V spring 30 for pressing the thermal head 10 toward the platen roller 20 as illustrated in FIG. 6. The letter-V spring 30, when installed in the printer apparatus as illustrated in FIG. 6, exerts a restoring force in the direction indicated by arrows in FIG. 6. Specifically, the restoring force acts in such a direction as to narrow the letter-V shape in the state illustrated in FIG. 6. Namely, the letter-V spring 30 is installed such that the restoring force serves to bring the first part 31 and the second part 32 of the letter-V spring 30 closer to each other. In the present embodiment, the first part 31 of the letter-V spring 30 is secured in contact with the recording paper guide 50 made of resin material, and a head contact 33 of the second part 32 is in contact with the back face of the thermal head 10, thereby pressing the thermal head 10 toward the side where the platen roller 20 is situated. The head contact 33 is formed by bending the end of the second part 32 of the letter-V spring 30 into an arc shape.

The printer apparatus of the present embodiment utilizes the letter-V spring 30 as described above to press the thermal head 10 against the platen roller 20. Even in the case of the frame being made of resin material, the frame does not deform because the above-noted configuration ensures that the force of the letter-V spring 30 is not applied to the frame. It is thus safe to make the frame by use of resin material. Further, there is no need to provide a frame for supporting the letter-V spring 30, which enables the size reduction of the printer apparatus as well as cost reduction.

Figure 7A:
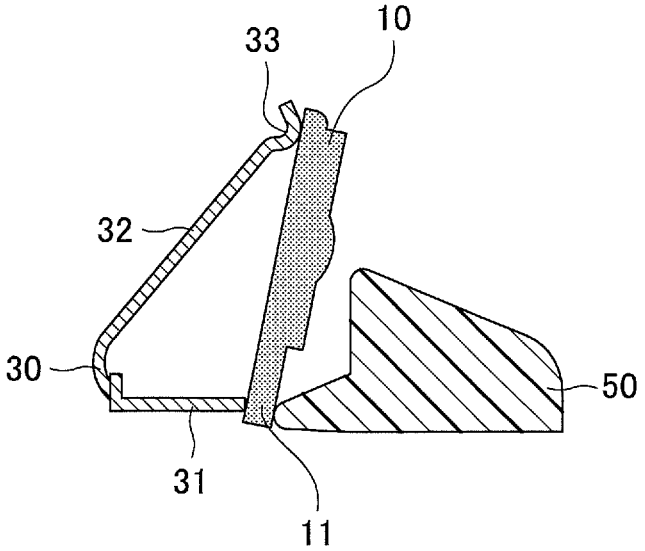
FIG. 7A is a drawing illustrating the printer apparatus of the present embodiment.
Figure 7B:
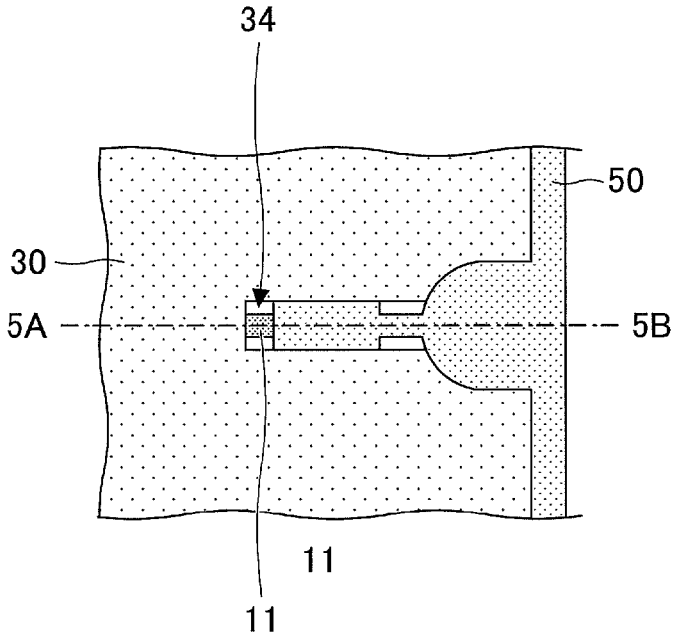
FIG. 7B is a drawing illustrating the printer apparatus of the present embodiment.

As illustrated in FIGS. 7A and 7B, a projection 11 formed at an end of the thermal head 10 opposite from the side of the thermal head 10 for printing on printing paper (not shown) is inserted into a groove 34 formed in the first part 31 of the letter-V spring 30. The projection 11 is wedged between the first part 31 of the letter-V spring 30 and the recording paper guide 50 made of resin material. The projection 11 of the thermal head 10 serves as a rotation axis when the letter-V spring 30 presses the thermal head 10 toward the platen roller 20. FIG. 7B is a bottom view. FIG. 7A is a cross-sectional view taken along a dot-and-dash line 7A-7B in FIG. 7B. It may be noted that FIG. 7A shows a cross-sectional view taken at a different cross-sectional position than in FIG. 6.

Figure 8:
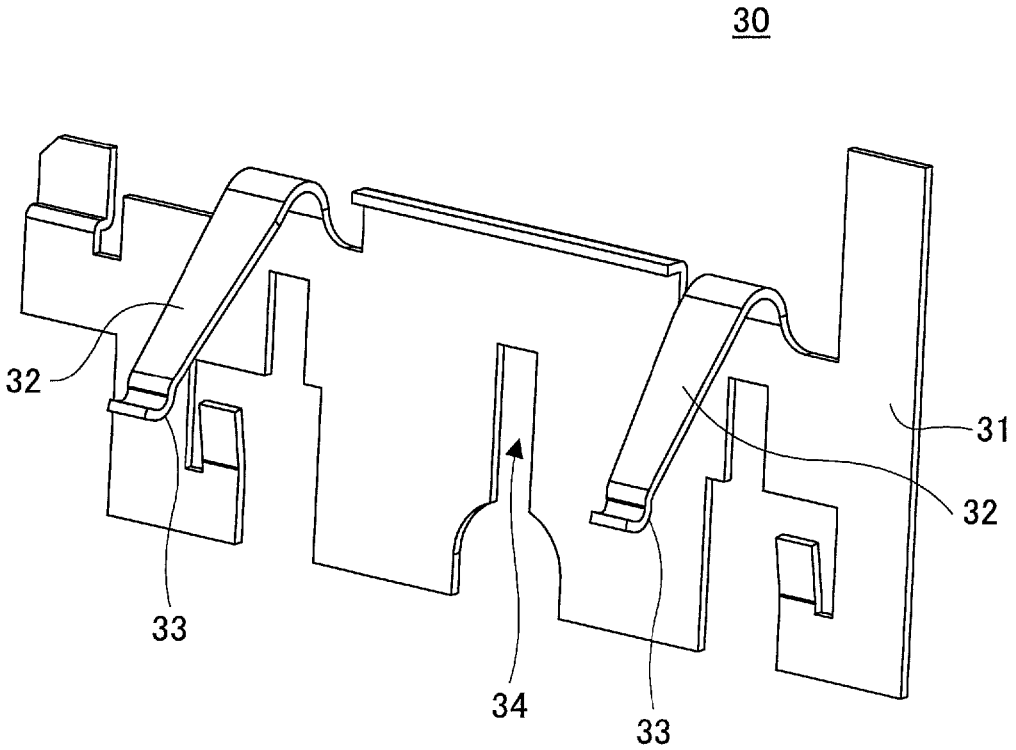
FIG. 8 is an axonometric view of a letter-V spring.

In the following, the letter-V spring 30 will be described in more detail with reference to FIG. 8. The letter-V spring 30 has the first part 31 and the second part 32, which are parts of a single seamless, continuous metal plate. The portion that serves as the second part 32 is bent relative to the portion serving as the first part 31. More than one second part 32 may be formed as part of the letter-V spring 30 in order to apply uniform pressure to the thermal head 10. The end of the second part 32 has the head contact 33 that comes in contact with the thermal head 10 for the purpose of applying a force to the thermal head 10. The first part 31 has a wide flat shape for serving as part of a frame, a center part of which has the groove 34 into which the projection 11 of the thermal head 10 can be inserted. The projection 11 of the thermal head 10 is wedged between the letter-V spring 30 and the recording paper guide 50 in the groove 34 of the first part 31 of the letter-V spring 30 such as to be rotatable. With this arrangement, the thermal head 10 is able to rotate around the projection 11 serving as a rotation axis.

The letter-V spring 30 is made of metal material such as stainless, and thus has the function to release heat generated by a conveyance motor 60 or the like, which will be described later. The letter-V spring 30 can also serve as part of the ground due to its high electrical conductivity. Further, the letter-V spring 30 has high strength, so that the first part 31 of the letter-V spring 30 may also constitute part of the housing of the printer apparatus.

Figure 9:
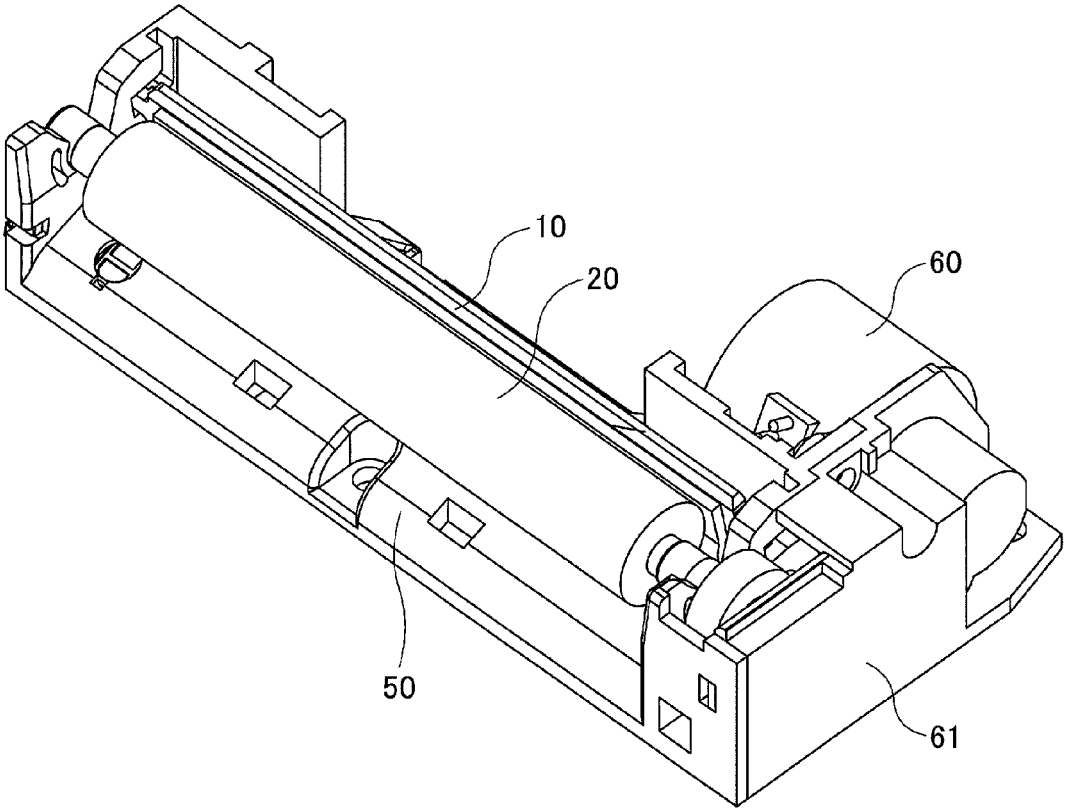
FIG. 9 is an axonometric view of the printer apparatus according to the present embodiment.
Figure 10:
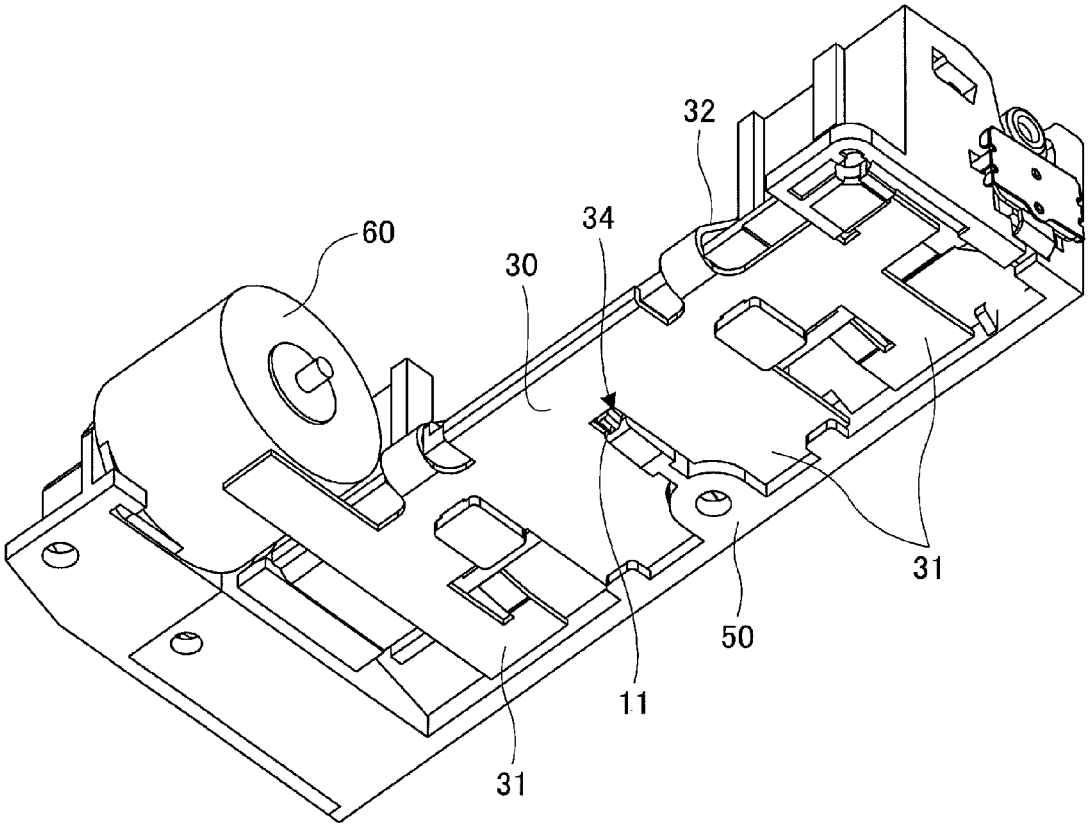
FIG. 10 is an axonometric view of the printer apparatus according to the present embodiment.

FIG. 9 and FIG. 10 are axonometric views of the printer apparatus of the present embodiment. The printer apparatus of the present embodiment includes the conveyance motor 60 for rotating the platen roller 20 and a gear box 61 for transmitting the rotation of the conveyance motor 60 to the platen roller 20. The frame of the present embodiment may be made of resin. The recording paper guide 50 is formed seamlessly with the frame.

FIG. 10 is an axonometric view of the printer apparatus of the present embodiment with the bottom face thereof being illustrated. The frame has the letter-V spring 30 mounted thereon. A portion of the recording paper guide 50 is inserted into the groove 34. The projection 11 is wedged between, and supported by, the groove 34 and the portion of the recording paper guide 50. The first part 31 of the letter-V spring 30 covers part of the frame of the printer apparatus made of resin material or the like. The head contact 33 of the second part 32 presses the thermal head 10. Accordingly, unlike the configuration illustrated in FIG. 1, the restoring force of the letter-V spring 30 does not damage the frame.

Figure 11A:
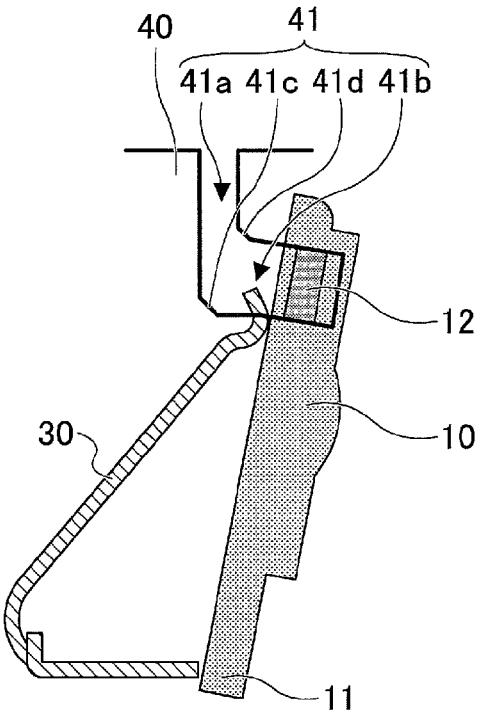
FIG. 11A is a drawing illustrating the printer apparatus of the present embodiment.

In the printer apparatus of the present embodiment, as illustrated in FIG. 11A, thermal-head positioning projections 12 project from the side faces (i.e., faces parallel to the plane of the sheet of FIG. 11A) on both sides of the thermal head 10 in the directions perpendicular to the plane of the sheet of FIG. 11A. The side faces of a frame 40 have letter-L grooves 41 formed therein, respectively. For the sake of convenience, FIGS. 11A and 11B and FIGS. 12A through 12D show a side face of the frame 40 as being in a transparent state, so that only the outlines of the side face of the frame 40 and the letter-L grooves 41 are illustrated in solid lines. A groove 41 includes a straight area 41*a* formed straight near the entrance to the groove, a positioning area 41*b* formed toward a side at the bottom of the straight area 41*a*, and a slanted part 41*c* situated between the straight area 41*a* and the positioning area 41*b*. The positioning area 41*b* serves to position the thermal-head positioning projection 12 inserted into the groove 41. The letter-L groove 41 has an upper slanted part 41*d* formed on a side opposite from the slanted part 41*c*. The slanted part 41*c* and the upper slanted part 41*d* are formed by beveling the letter-L corners of the letter-L groove 41.

The thermal-head positioning projections 12 situated on both sides of the thermal head 10 for being inserted into the letter-L grooves 41 have a rectangular shape. The width of the positioning areas 41*b* is defined such that the thermal-head positioning projections 12 entering the positioning areas 41*b* are settled at a predetermined position. Namely, the thermal-head positioning projections 12 are capable of tightly engaging with the positioning areas 41*b*, which enables the thermal head 10 to be installed at the predetermined position. In the present embodiment, the frame 40 having the side faces in which the grooves 41 are formed may be made of resin material, processed metal plates, or metal material such as die cast.

The slanted part 41*c* has a slanted face extending in a direction different from the direction in which the thermal-head positioning projection 12 moves in the straight area 41*a* and also different from the direction in which the thermal-head positioning projection 12 moves in the positioning area 41*b*. The upper slanted part 41*d* has a slanted face extending substantially parallel to the slanted face of the slanted part 41*c*.

In the printer apparatus of the present embodiment, the thermal-head positioning projections 12 formed at both sides of the thermal head 10 move into the positioning areas 41*b* through the slanted parts 41*c* from the straight areas 41*a* of the letter-L grooves 41. In the state in which the thermal-head positioning projections 12 are situated in the positioning areas 41*b*, the letter-V spring 30 presses the thermal head 10 from the backside thereof toward the platen roller 20, thereby placing the thermal head 10 in position.

Figure 11B:
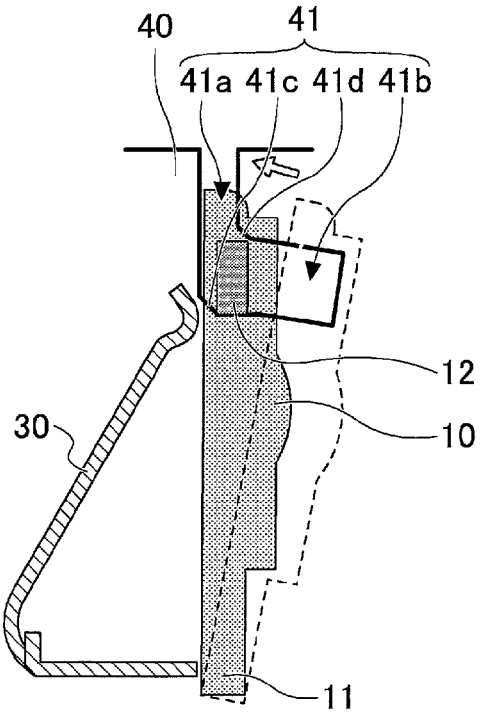
FIG. 11B is a drawing illustrating the printer apparatus of the present embodiment.

In order to remove the thermal head 10 from the printer apparatus of the present embodiment, the letter-V spring 30 is bent against the restoring force of the letter-V spring 30, or the letter-V spring 30 is removed, followed by moving the thermal-head positioning projections 12 formed at both sides of the thermal head 10 from the positioning areas 41*b* to the straight areas 41*a* of the letter-L grooves 41. In the state in which the spring is attached, however, the thermal-head positioning projection 12 is obstructed by the slanted part 41*c* of the letter-L groove 41 to stop at the border between the positioning area 41*b* and the slanted part 41*c*, thereby failing to enter the straight area 41*a* as illustrated in FIG. 11B. Because of this, the thermal head 10 does not disengage and fall off from the letter-L groove 41.

A more detailed explanation will be given with reference to FIGS. 12A through 12D. In the initial state illustrated in FIG. 12A, the thermal head 10 is pressed toward the platen roller 20 by the letter-V spring 30 (see FIG. 11A). In this state, the thermal-head positioning projection 12 is placed in the positioning area 41*b* of the letter-L groove 41 formed in the frame 40, so that the thermal head 10 is installed at the predetermined position.

Figure 12A:
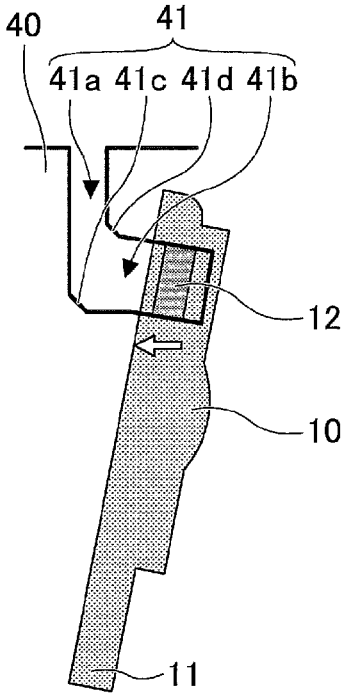
FIG. 12A is a drawing illustrating the printer apparatus of the present embodiment.
Figure 12B:
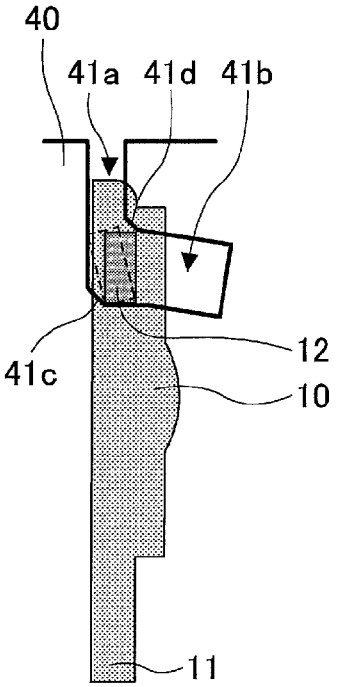
FIG. 12B is a drawing illustrating the printer apparatus of the present embodiment.

Subsequently, a force is applied to the letter-V spring 30 (see FIG. 11B), or the letter-V spring 30 is removed, such that the force pressing the thermal head 10 toward the platen roller 20 is removed. This allows the thermal-head positioning projection 12 to move to the border between the positioning area 41*b* and the slanted part 41*c* of the groove 41 as illustrated in FIG. 12B. In this state, the thermal-head positioning projection 12 abuts the lower end of the slanted part 41*c* (i.e., the end of the slanted part 41*c* situated toward the positioning area 41*b*), and is prevented from moving further into the straight area 41*a* (i.e., does not move further toward the straight area 41*a*). In the state in which the thermal-head positioning projection 12 abuts the lower end of the slanted part 41*c*, the thermal-head positioning projection 12, which is situated outside the straight area 41*a* of the groove 41, has the upper end thereof being blocked by the upper slanted part 41*d*, thereby being restricted as to the upward movement thereof in the figure. Because of this, the thermal head 10 does not disengage and fall off.

Figure 12C:
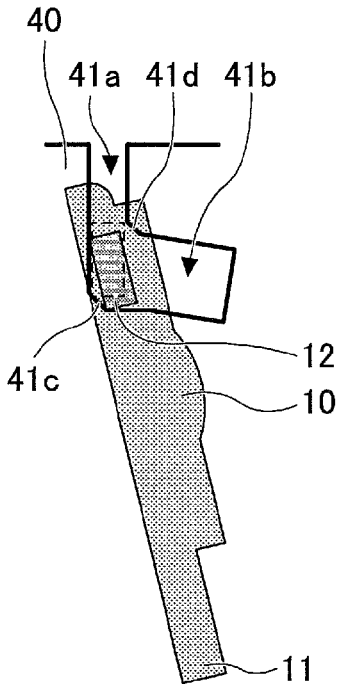
FIG. 12C is a drawing illustrating the printer apparatus of the present embodiment.

Subsequently, as illustrated in FIG. 12C, the entirety of the thermal head 10 is shifted from the position illustrated in FIG. 12B, such that a portion of the thermal-head positioning projection 12, e.g., the portion of the thermal-head positioning projection 12 closest to the exit from the letter-L groove 41, enters the straight area 41*a* of the letter-L groove 41 formed in the frame 40. For example, the thermal head is rotated counterclockwise in the figure from the position illustrated in FIG. 12B around the thermal-head positioning projection 12.

Figure 12D:
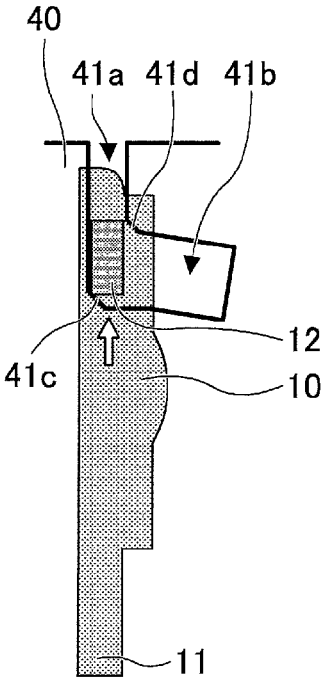
FIG. 12D is a drawing illustrating the printer apparatus of the present embodiment.

As illustrated in FIG. 12D, then, the portion of the thermal-head positioning projection 12 farthest away from the exit from the letter-L groove 41 is moved into the straight area 41*a* such that the entirety of the thermal-head positioning projection 12 is situated in the straight area 41*a* of the letter-L groove 41. This allows the thermal-head positioning projection 12 to be taken out of the straight area 41*a* of the letter-L groove 41 formed in the frame 40 toward the outside of the groove 41.

With the above-noted arrangement, the printer apparatus of the present embodiment prevents the thermal-head positioning projection 12 from easily disengaging from and falling off the groove 41 of the frame 40 even when the letter-V spring 30 is removed.

Further, although a description has been given with respect to one or more embodiments of the present invention, the contents of such a description do not limit the scope of the invention.

The present application claims foreign priority to Japanese priority application No. 2014-113250 filed on May 30, 2014 with the Japanese Patent Office, the entire contents of which are hereby incorporated by reference.

DESCRIPTION OF REFERENCE SYMBOLS

10 thermal head
11 rotational projection
12 thermal-head positioning projection
20 platen roller
30 letter-V spring
31 first part
32 second part
33 head contact
34 groove
40 frame
41 groove
41*a* straight area
41*b* positioning area
41*c* slanted part
41*d* upper slanted part
50 recording paper guide
60 conveyance motor
61 gear box
70 recording paper sensor

The invention claimed is:

1. A printer apparatus, comprising:
a print head;
a platen roller; and
a frame,
wherein printing is performed on recording paper situated between the print head and the platen roller,
wherein a projection is formed at a side face of the print head,
wherein a side face of the frame has a groove formed therein for receiving the projection,
wherein the groove includes a first area constituting an entrance to the groove, a second area for positioning the projection and formed such as to extend in a direction intersecting with a direction in which the first area extends, and a slanted part formed between the first area and the second area, and
wherein the slanted part is a pair of opposite edges of the groove, and the opposite edges extend in a direction different from both a direction in which the projection moves in the first area and a direction in which the projection moves in the second area, the opposite edges facing each other across a space of the groove.

2. The printer apparatus as claimed in claim 1, further comprising:
a spring configured to press the print head toward the platen roller; and
a recording paper guide configured to guide recording paper placed between the print head and the platen roller,
wherein a first part of the spring is in contact with the print head, and a restoring force of the spring acts in such a direction as to narrow a distance between the first part and a second part of the spring.

3. A printer apparatus, comprising:
a print head;
a platen roller; and
a frame,
wherein printing is performed on recording paper situated between the print head and the platen roller,
wherein a projection is formed at a side face of the print head,
wherein a side face of the frame has a groove formed therein for receiving the projection,
wherein the groove includes a first area constituting an entrance to the groove, a second area for positioning the projection and formed such as to extend in a direction intersecting with a direction in which the first area extends, and a slanted part formed between the first area and the second area, wherein the slanted part is an edge of the groove and extends in a direction different from both a direction in which the projection moves in the first area and a direction in which the projection moves in the second area, and wherein the print head has a projection on a side thereof opposite from a side that is in contact with the platen roller, and the projection is wedged between the first part of the spring and the recording paper guide in a rotatable manner.

* * * * *